US012213608B2

(12) United States Patent
Shamp et al.

(10) Patent No.: US 12,213,608 B2
(45) Date of Patent: Feb. 4, 2025

(54) PARCEL BOXES HAVING BAFFLE ASSEMBLIES AND METHODS

(71) Applicant: THE STEP2 COMPANY, LLC, Streetsboro, OH (US)

(72) Inventors: Travis D. Shamp, Akron, OH (US); Patrick Ritossa, Chesterland, OH (US)

(73) Assignee: The Step2 Company, LLC, Streetsboro, OH (US)

( * ) Notice: Subject to any disclaimer, the term of this patent is extended or adjusted under 35 U.S.C. 154(b) by 19 days.

(21) Appl. No.: 18/134,178

(22) Filed: Apr. 13, 2023

(65) Prior Publication Data

US 2023/0355019 A1 Nov. 9, 2023

Related U.S. Application Data

(60) Provisional application No. 63/339,605, filed on May 9, 2022.

(51) Int. Cl.
*A47G 29/124* (2006.01)

(52) U.S. Cl.
CPC ..... *A47G 29/1248* (2017.08); *A47G 29/1251* (2017.08); *A47G 2400/126* (2013.01)

(58) Field of Classification Search
CPC ..... A47G 29/1216; A47G 29/12095; A47G 29/1248; A47G 29/1251; A47G 29/141; A47G 29/124; A47G 29/20; A47G 29/22; A47G 2029/1257; A47G 2400/126
See application file for complete search history.

(56) References Cited

U.S. PATENT DOCUMENTS 132,865 A * 11/1872 Sinclaire ..... A47G 29/12095 43/67
400,299 A * 3/1889 Chappell et al. ..... A47G 29/12095 232/53
413,928 A * 10/1889 Cook ..... A47G 29/1207 43/69
RE11,059 E * 2/1890 Chappell et al. ..... 232/48
(Continued)

OTHER PUBLICATIONS

KeTeR 17209238 Parcel Drop Box Instruction Manual, Keter Plastic Ltd., Herzliya, Israel, Apr. 10, 2022, retrieved from https://manuals.plus/keter/17209238-parcel-drop-box-manual#axzz7ymjRTfOp, 35 pages.

*Primary Examiner* — William L Miller
(74) *Attorney, Agent, or Firm* — Frost Brown Todd LLP

(57) ABSTRACT

A parcel box includes an external shell and upper and lower baffles. The external shell includes left and right side walls, a front wall, a rear wall, a base, a cover and a door. Each of the cover and the door are movable between closed and opened positions, respectively. When opened, the cover facilitates access by parcels through a top opening and into a storage area. When opened, the door facilitates removal of parcels from the storage area and through a bottom opening. The upper baffles are pivotally coupled to the front wall, independently movable about an upper common pivot axis between deployed positions and depressed positions, and independently spring-biased toward the deployed positions. The lower baffles are pivotally coupled to the rear wall, independently movable about a lower common pivot axis between deployed positions and depressed positions, and independently spring-biased toward the deployed positions.

20 Claims, 15 Drawing Sheets

(56) References Cited

U.S. PATENT DOCUMENTS 455,373 A * 7/1891 Wesson ..... A47G 29/1225 232/36
461,208 A * 10/1891 Markell ..... A47G 29/1216 232/54
465,867 A * 12/1891 Lindsay ..... A47G 29/1201 232/24
524,637 A * 8/1894 Johnson ..... A47G 29/1201 232/24
533,518 A * 2/1895 Witte ..... A47G 29/1216 232/54
722,323 A * 3/1903 Parker ..... A47G 29/1216 232/54
741,865 A * 10/1903 Williams ..... A47G 29/12095 232/53
807,764 A * 12/1905 Mowers et al. . A47G 29/12095 232/48
1,111,031 A * 9/1914 Petri ..... A47G 29/12095 43/67
1,136,979 A * 4/1915 Slagow ..... A47G 29/12095 43/66
1,228,057 A * 5/1917 Schaffer ..... A47G 29/20 232/54
1,779,290 A * 10/1930 Psaila ..... A47G 29/20 232/41 R
4,753,386 A * 6/1988 Phillion, Sr. ..... A47G 29/121 232/17
5,080,251 A * 1/1992 Noack ..... B65F 1/1607 220/254.3
5,435,484 A * 7/1995 Carlson ..... A47G 29/1251 232/47
6,840,438 B2 * 1/2005 Hassan ..... A47G 29/1216 232/54
7,036,719 B1 * 5/2006 Helphrey ..... A47G 29/124 232/54
7,249,705 B2 * 7/2007 Dudley ..... A47G 29/141 340/5.6
7,854,374 B2 * 12/2010 Dudley ..... A47G 29/12095 232/47
10,368,676 B1 * 8/2019 Ansari ..... A47G 29/1248
10,512,352 B1 * 12/2019 Torres ..... A47G 29/22
11,064,831 B1 * 7/2021 Biddle ..... A47G 29/22
11,253,094 B1 * 2/2022 Deck ..... A47G 29/30
11,253,095 B2 * 2/2022 Carlson ..... A47G 29/16
11,503,936 B2 * 11/2022 Leng ..... A47G 29/1251
2003/0168507 A1 * 9/2003 Mihaylov ..... A61L 2/10 232/45
2004/0140347 A1 * 7/2004 Mihaylov ..... A47G 29/1212 232/31
2012/0031960 A1 * 2/2012 Skouboe ..... A47G 29/22 232/47
2017/0262800 A1 * 9/2017 Dorpfeld ..... G06Q 10/08
2020/0260896 A1 * 8/2020 Leng ..... A47G 29/1251
2021/0196071 A1 * 7/2021 Gecho ..... A47G 29/30
2023/0200578 A1 * 6/2023 Chhina ..... A47G 29/1251 232/24

* cited by examiner

PARCEL BOXES HAVING BAFFLE ASSEMBLIES AND METHODS

REFERENCE TO RELATED APPLICATION

This application claims priority of U.S. provisional patent application Ser. No. 63/339,605 filed May 9, 2022, entitled "Parcel Boxes Having Baffle Assemblies And Methods," and hereby incorporates this provisional patent application by reference herein in its entirety.

TECHNICAL FIELD

Parcel boxes and methods described herein can include baffles arranged in a manner to deter theft of parcels.

BACKGROUND

It is common for parcels to be delivered to a front porch or near a mailbox of a residence or business. Such parcels can be susceptible to damage or theft.

SUMMARY

In accordance with one embodiment, a parcel box comprises an external shell, an upper baffle assembly, and a lower baffle assembly. The external shell comprises a left side wall, a right side wall, a front wall, a rear wall, a base, a cover and a door. The cover is movable between a closed position and an opened position. In the opened position, the cover facilitates access by parcels through a top opening and into a storage area. The door is movable between a closed position and an opened position. In the opened position, the door facilitates removal of parcels from the storage area and through a bottom opening. The upper baffle assembly comprises a plurality of upper baffles, each being pivotally coupled to the front wall, independently movable about an upper common pivot axis between deployed positions and depressed positions, and independently spring-biased toward the deployed positions. The lower baffle assembly comprises a plurality of lower baffles, each being pivotally coupled to the rear wall, independently movable about a lower common pivot axis between deployed positions and depressed positions, and independently spring-biased toward the deployed positions.

BRIEF DESCRIPTION OF THE DRAWINGS

It is believed that certain embodiments will be better understood from the following description taken in conjunction with the accompanying drawings in which.

DETAILED DESCRIPTION

Figure 1:
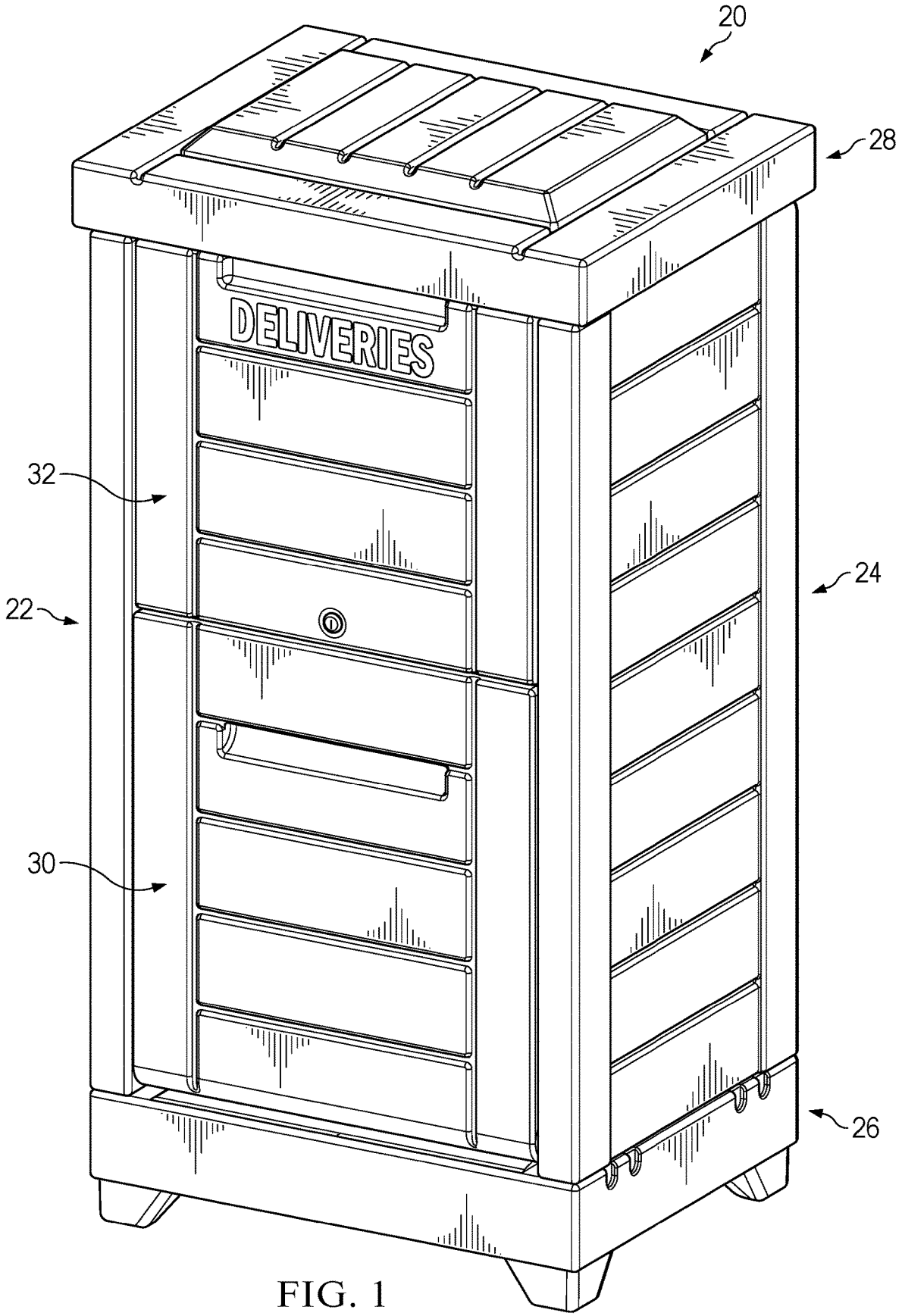
FIG. 1 is a right front perspective view depicting a parcel box in accordance with one embodiment, wherein a cover and a door are each in respective closed positions.
Figure 2:
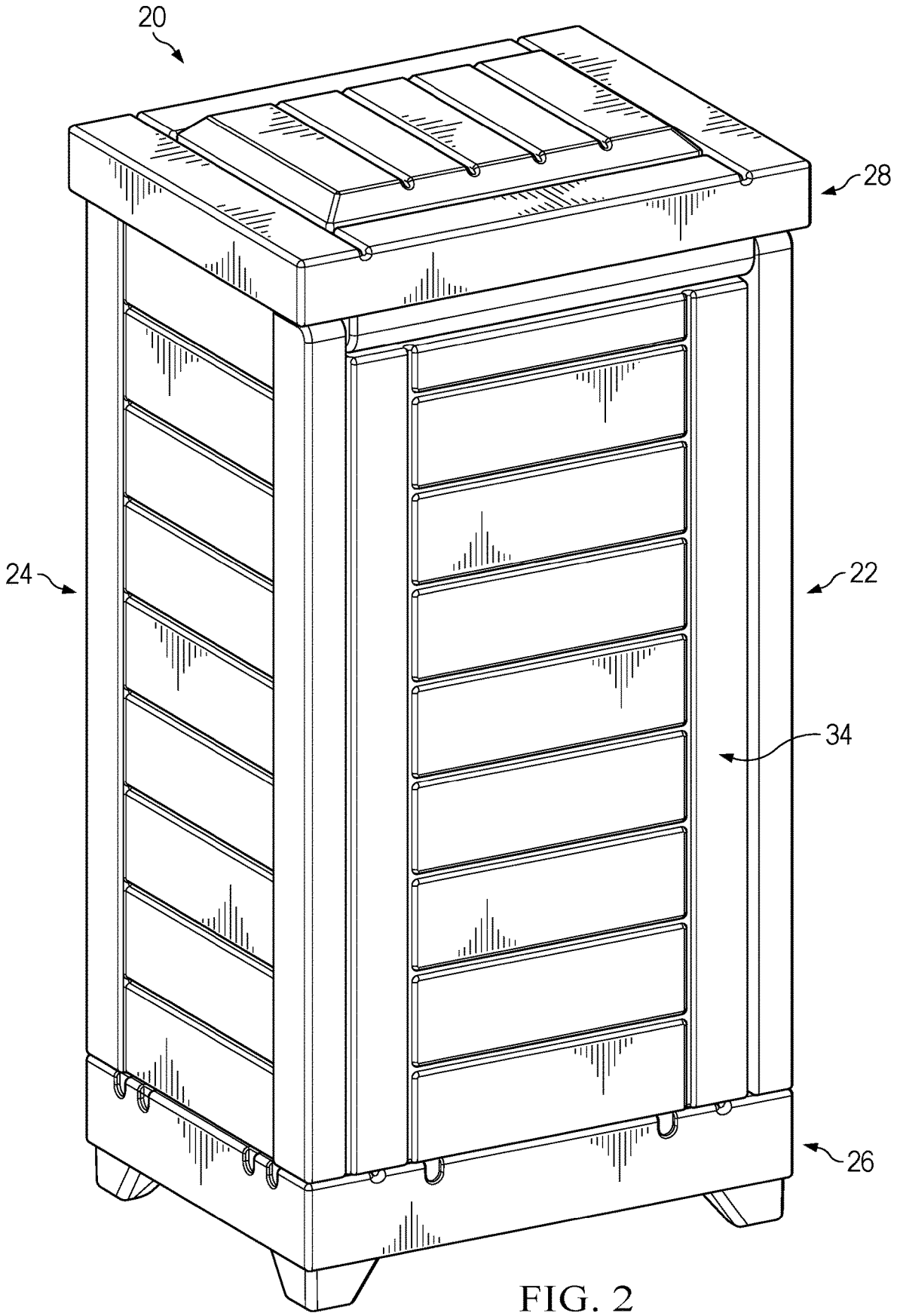
FIG. 2 is a left rear perspective view depicting the parcel box of FIG. 1.

Selected embodiments are hereinafter described in detail in connection with the views and examples of FIGS. 1-15, wherein like numbers indicate the same or corresponding elements throughout the views. More particularly, structure and operation of a parcel box 20 is herein described in reference to FIGS. 1-15. The parcel box 20 is shown in FIGS. 1-2 to have an external shell structure including side walls 22 and 24, a front wall 32, a rear wall 34, a base 26, a cover 28 and a door 30. In one embodiment, the side walls 22 and 24 can be fixedly fastened to the and the rear wall 34 and the base 26 such as with fasteners and/or interlocking mechanical features. The front wall 32 can be fixedly fastened to each of the side walls 22 and 24 such as with fasteners and/or interlocking mechanical features. The rear wall 34 can be fixedly fastened to the base 26 such as with fasteners and/or interlocking mechanical features. In other embodiments, walls can be coupled with one another and/or a base through other arrangements and/or can be integrally formed as a unitary component with one another. In one embodiment, the side walls 22 and 24, front wall 32, rear wall 34, base 26, cover 28 and door 30 can each be formed from plastic, such as in a rotary molding, blow molding or injection molding process. However, in other embodiments, it will be appreciated that one or more of these components can be formed from materials other than plastic, such as wood, metal, fiberglass or otherwise.

Figure 3:
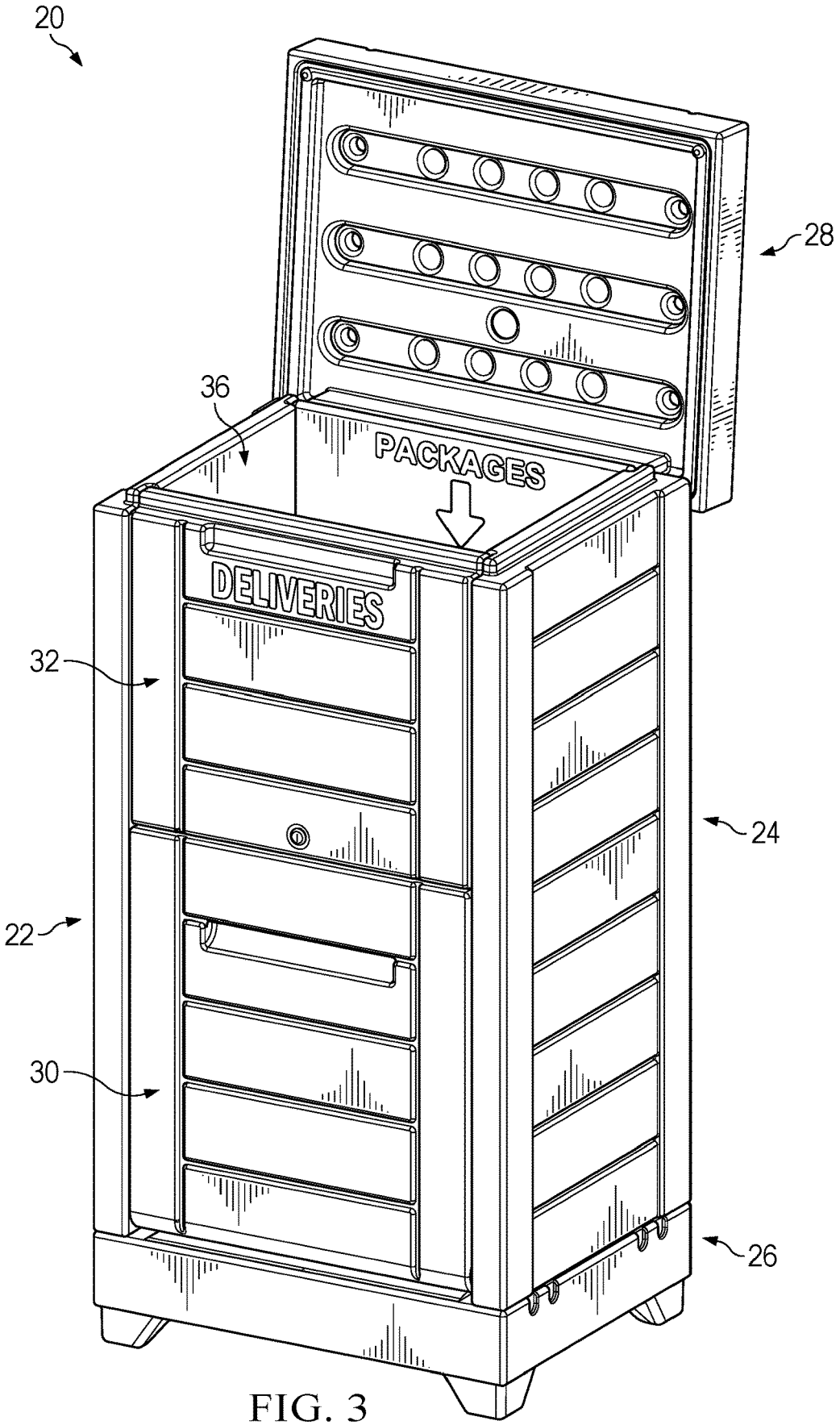
FIG. 3 is a right front perspective view depicting the parcel box of FIGS. 1-2, but wherein the cover is in an opened position.

In one embodiment, the cover 28 can be pivotally coupled with the side walls 22 and 24, as generally shown in FIG. 3 for example. The cover 28 can be pivoted from a closed position (FIG. 1) to an opened position (FIG. 3). In the opened position, the cover 28 can facilitate access by parcels through an opening 36 and into a storage area 56 (FIG. 4) of the parcel box 20. It will be appreciated that, in other embodiments, a cover can be coupled to one or more side walls without use of a pivot (e.g., with a fabric or rope tether), can instead be pivotally or otherwise coupled with a front wall, side wall or rear wall, and/or can be configured to be selectively removable namely without being attached or coupled with any side wall, front wall or rear wall.

Figure 4:
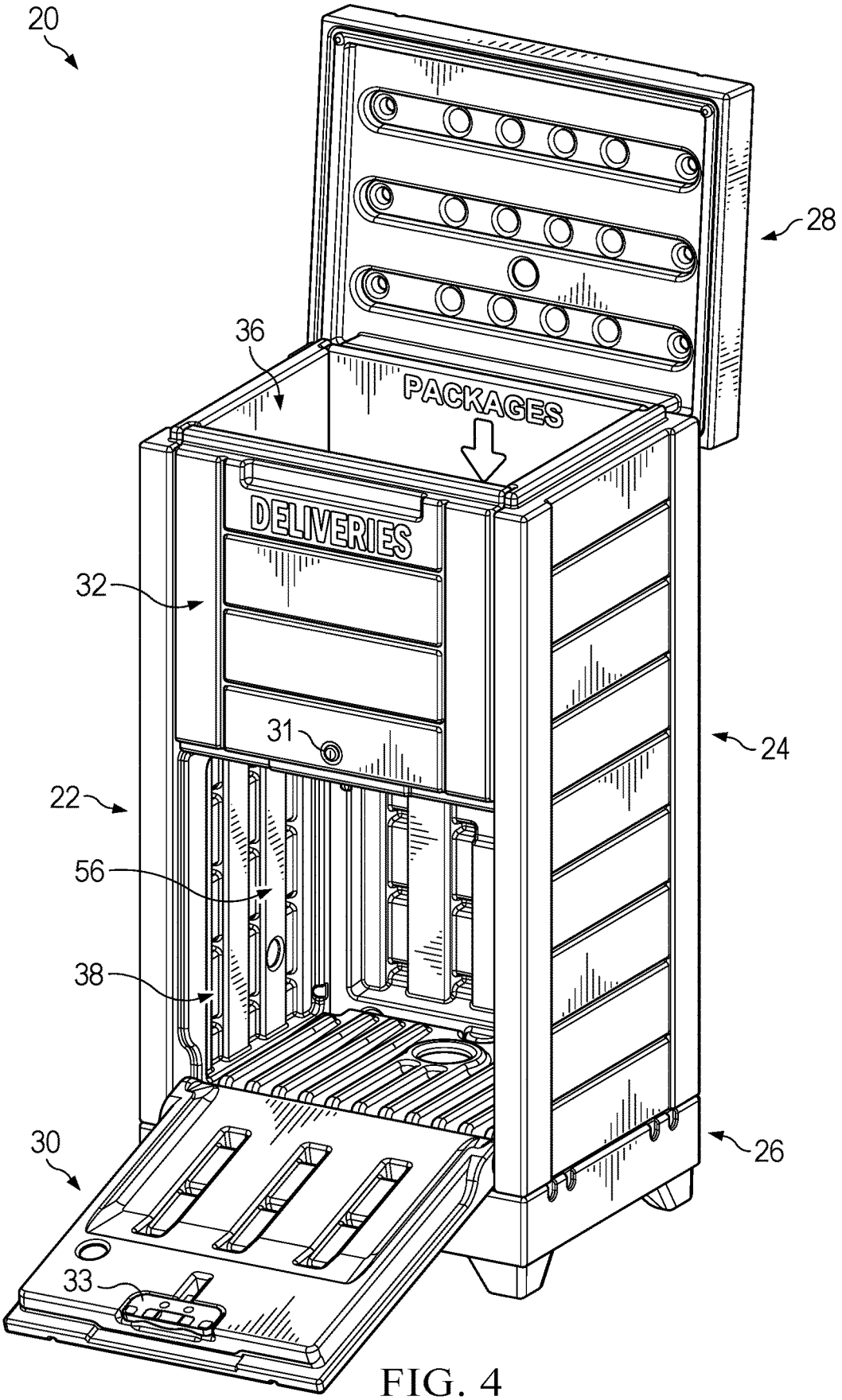
FIG. 4 is a right front perspective view depicting the parcel box in the configuration of FIG. 3, but wherein the door is also in an opened position.

In one embodiment, the door 30 can be pivotally coupled with the side walls 22 and 24 and selectively moveable between a closed position (FIG. 1) and an opened position (FIG. 4). In the opened position, the door 30 can facilitate removal of parcels from the storage area 56 and through a bottom opening 38. It will be appreciated that, by pivoting the door 30 downwardly (about a horizontal axis) to facilitate opening of the door 30 as shown in FIG. 4, the door 30 can be configured not to interfere with or reduce the size of the bottom opening 38, thereby facilitating removability of larger parcels from the storage area 56 as might otherwise be possible. However, it will be appreciated that, in other embodiments, a door can instead be configured to be selectively pivoted upwardly (about a horizontal axis) or laterally (about a vertical axis) to facilitate opening of the door, and in such configurations can be coupled with a left side wall, a right side wall, a front wall, and/or a base.

A lock 31 is shown in FIG. 4 to be mounted in the front wall 32 and can be selectively rotated (e.g., by a removable security key) between a latching position and an unlatching position. When in the latching position, the lock 31 can maintain the door 30 in the closed position (FIG. 1). However, when in the unlatching position, the lock 31 can allow movement of the door 30 to the opened position (FIG. 4). In one embodiment, as shown in FIG. 4, the door 30 can comprise a reinforced catch plate 33 to facilitate added strength and resistance to prying of the door 30 when locked and in the closed position (FIG. 1). The reinforced catch plate 33 can be formed from ABS, Nylon, polypropylene, or other plastic, metal, or material.

Figure 11:
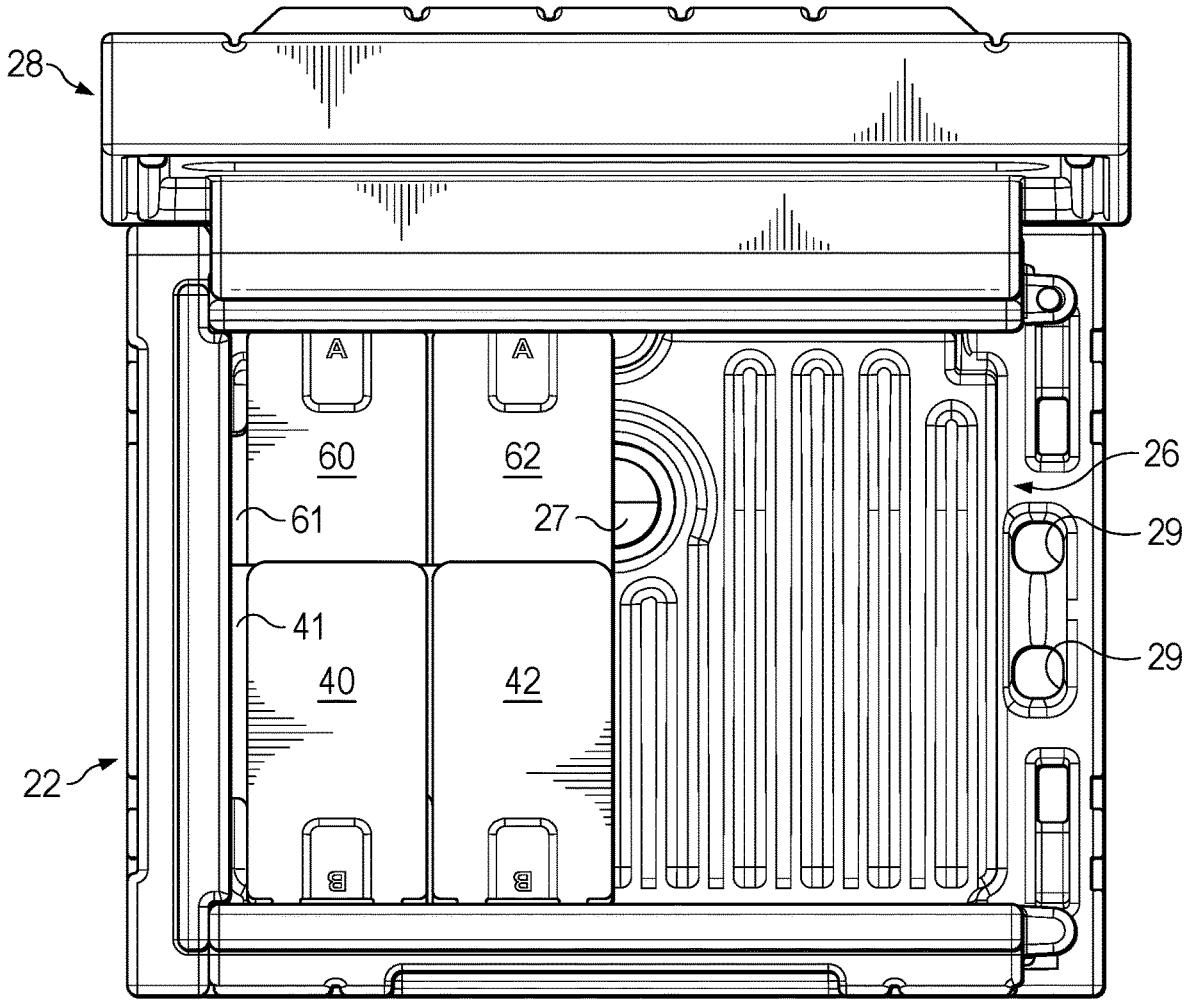
FIG. 11 is a top plan view depicting the parcel box in the configuration of FIG. 8.

In one embodiment, the base 26 can include a fill aperture 27 (FIG. 11). Sand, gravel or water, for example, can be provided as ballast into the base 26 through the fill aperture 27, and a plug can then be provided to seal the fill aperture 27. It will be appreciated that this ballast can serve to provide enhanced rigidity and stability to the parcel box 20, can cause the parcel box 20 to be less likely to move during strong winds, and can cause the parcel box 20 to be less susceptible to being stolen. In addition, the base 26 can be provided with one or more securement apertures (e.g., 29 in FIG. 11) which can facilitate securement of the base 26 to a ground surface (e.g., by a U-shaped stake hammered through the apertures and into the ground) which, additionally, can provide enhanced rigidity and stability to the parcel box 20, can cause the parcel box 20 to be less likely to move during strong winds, and can cause the parcel box 20 to be less susceptible to being stolen. Additionally or alternatively, the base, the rear wall or another portion of the parcel box can be configured to receive a lockable security tether for securement of the parcel box to a nearby structure, to reduce likelihood that the parcel box can move such as during strong winds or attempted theft.

The parcel box 20 can include a plurality of baffles. For example, as shown in the embodiment of FIGS. 1-15, the parcel box 20 is shown to include an upper baffle assembly 48 and a lower baffle assembly 58. In one embodiment, as shown in the example of FIGS. 1-15, the upper baffle assembly 48 is similarly or identically made as the lower baffle assembly 58. However, in other embodiments, baffle assemblies of a parcel box can differ from one another.

Figure 7:
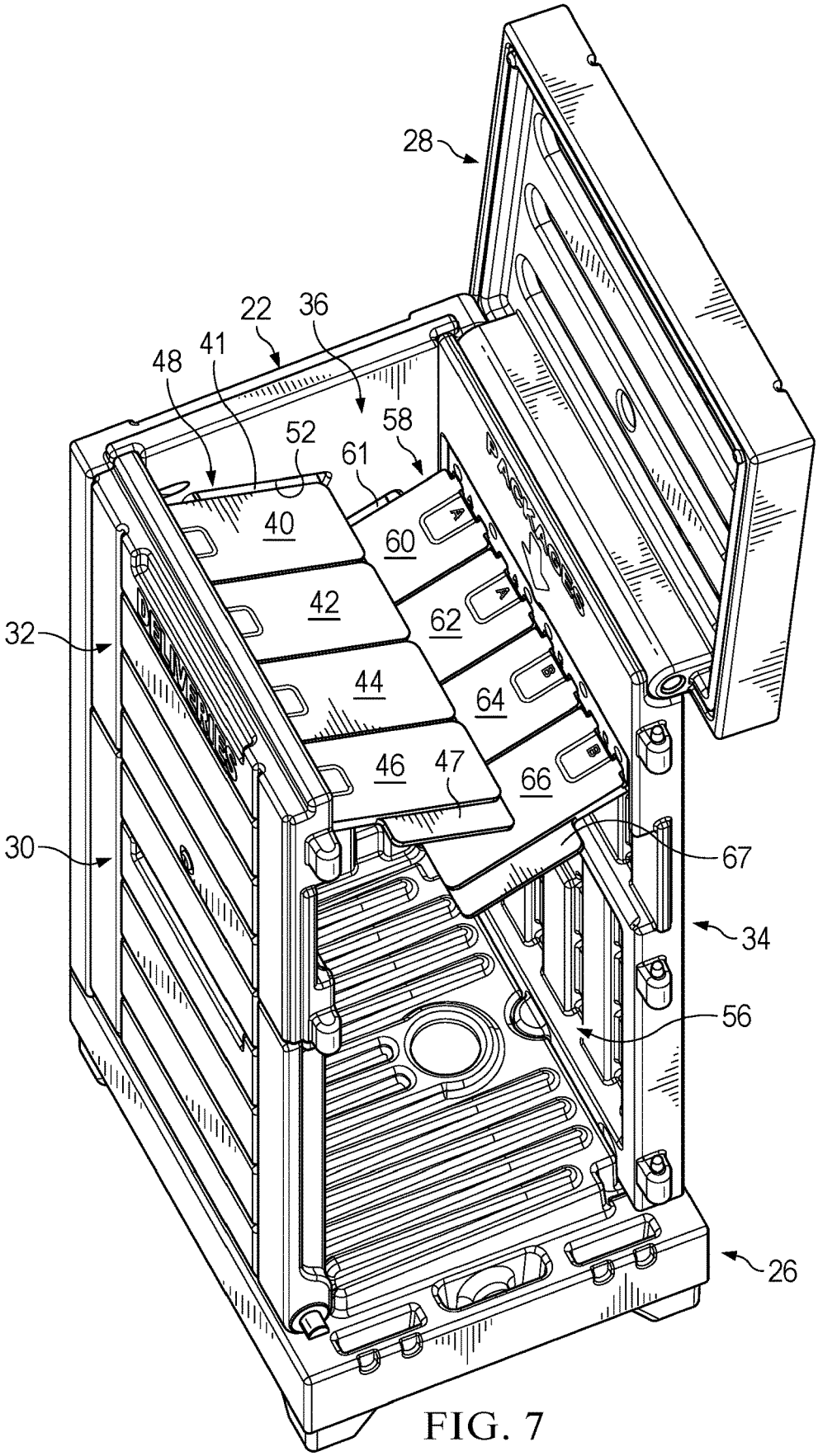
FIG. 7 is a right front perspective view depicting the parcel box in the configuration of FIG. 5, but wherein the cover is in an opened position.
Figure 9:
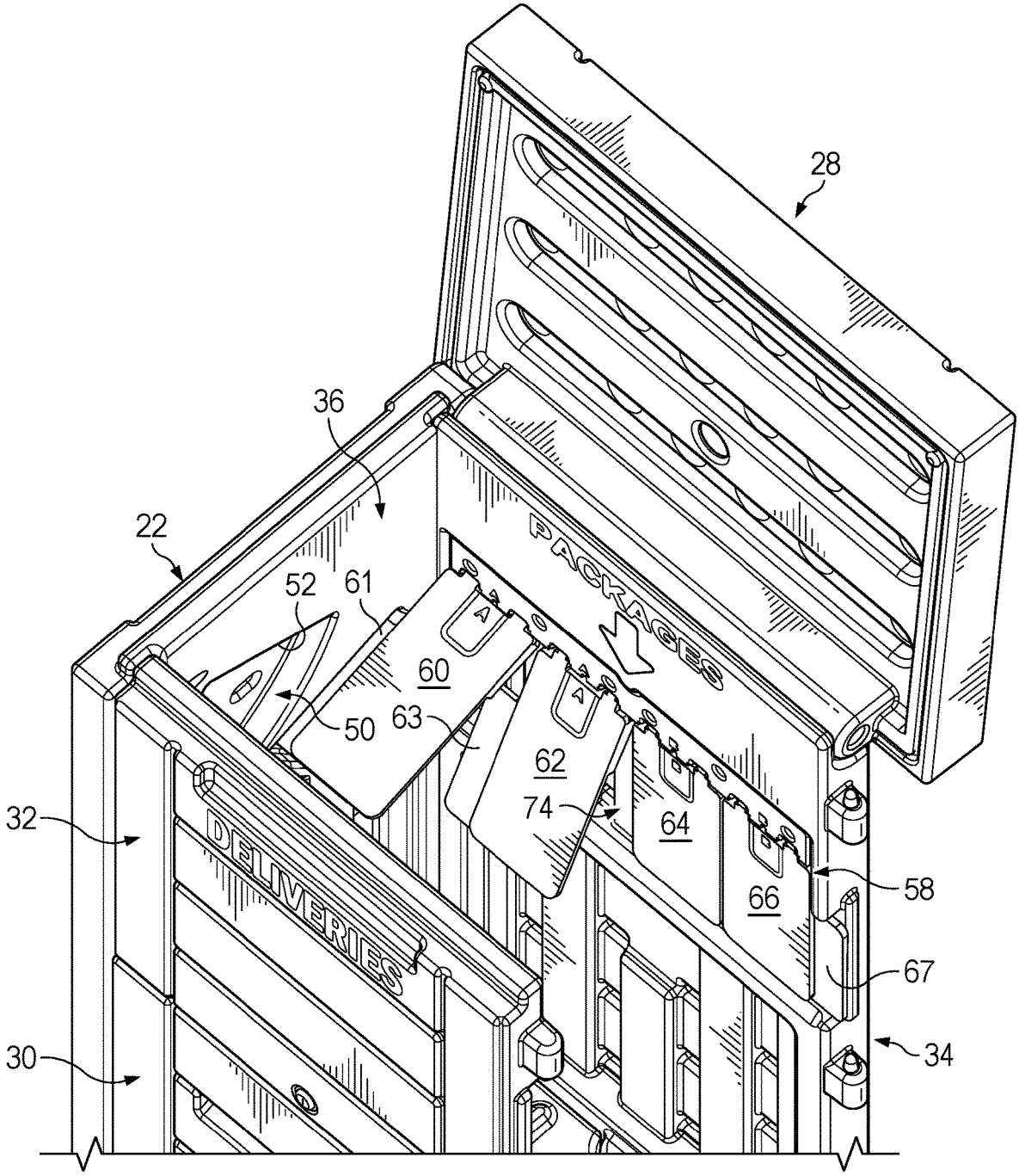
FIG. 9 is a right front perspective view depicting the parcel box in the configuration of FIG. 8, but wherein an additional baffle is shown in a partially depressed position.
Figure 10:
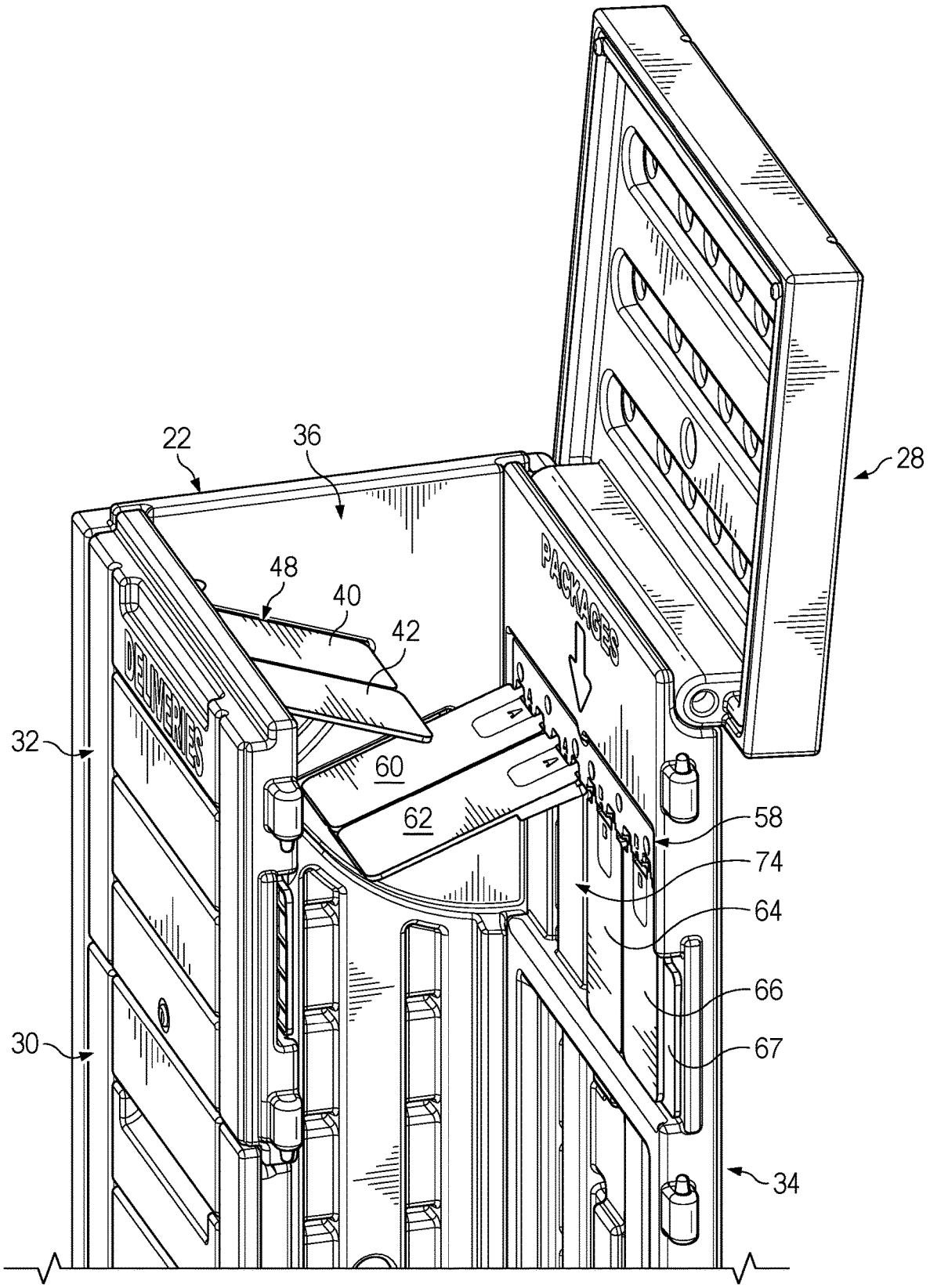
FIG. 10 is another right front perspective view depicting the parcel box in the configuration of FIG. 8.

Referring again to the embodiment of FIGS. 1-15, the upper baffle assembly 48 can include four separate baffles, namely baffles 40, 42, 44, and 46, that are each pivotally coupled to the front wall 32 of the parcel box 20, are independently spring-biased toward deployed positions (FIG. 7), and are each independently movable about a common pivot axis (A1 in FIG. 5) between deployed positions (FIG. 7) and depressed positions. The baffle 40 is shown in FIG. 7 to include a tab 41 which extends laterally outwardly toward the side wall 22. As will be appreciated with reference to FIGS. 1-15, the tab 41 can be received within a recess 50 (FIG. 8) formed in the side wall 22. The recess 50 is shown in FIG. 7 to be defined in part by a ledge 52 of the side wall 22. In this configuration, range of motion of the baffle 40 in the upward direction can be limited by contact of the tab 41 with the ledge 52, as shown in FIG. 10. Similarly, the baffle 42 can include a tab (not shown) that extends beneath the baffle 40 and selectively contacts the underside of the baffle 40. In this configuration, it will be appreciated that the baffle 42 can be independently depressed from the deployed position to the depressed position without necessarily resulting in movement of the baffle 40; however the baffle 40 cannot be depressed from the deployed position to the depressed position without also resulting in movement of the baffle 42 if not already at least correspondingly depressed. By providing baffles with tabs (e.g., 41), it will be appreciated that range of motion of the tabs in the upward direction can be restrained, such that excessive upward pivoting of the baffles can be prevented.

It will be appreciated that the baffles 44 and 46 can interact with one another and the side wall 24 in a similar manner as the baffles 40 and 42 interact with one another and the side wall 22. For example, range of motion of the baffle 46 in the upward direction can be limited by contact of a tab 47 (FIG. 7) of the baffle 46 with a ledge (not shown) associated with a recess (not shown) in the side wall 24. The ledge and the recess in the side wall 24 can be similar to the ledge 52 and the recess 50 in the side wall 22. Also, the baffle 44 can include a tab (not shown) that extends beneath the baffle 46 and selectively contacts the underside of the baffle 46. In this configuration, it will be appreciated that the baffle 44 can be independently depressed from the deployed position to the depressed position without necessarily resulting in movement of the baffle 46; however the baffle 46 cannot be depressed from the deployed position to the depressed position without also resulting in movement of the baffle 44 if not already at least correspondingly depressed.

The front wall 32 can define a receptacle 54 (FIG. 5) such that, when the baffles 40, 42, 44, and 46 are in their respective depressed positions, they can be at least nearly completely received within the receptacle 54 such that they do not obstruct passage of a parcel through the opening 36 to the storage area 56. For example, as shown in FIG. 11, the baffles 44 and 46 are not visible, as they are in their respective depressed positions and disposed within the receptacle 54.

Figure 8:
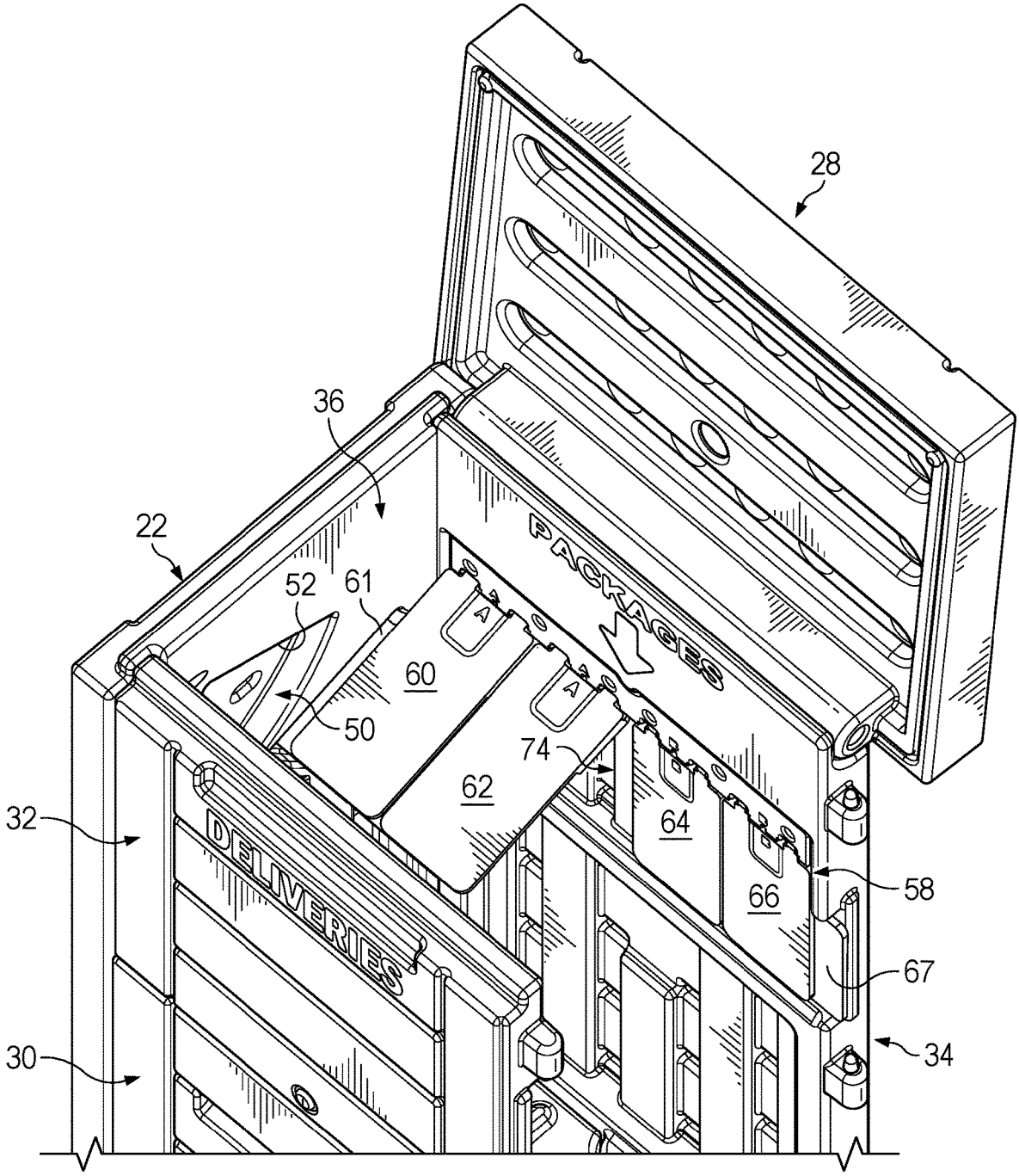
FIG. 8 is a right front perspective view depicting the parcel box in the configuration of FIG. 7, but wherein certain baffles are shown to be in depressed positions.

As further shown in the embodiment of FIGS. 1-15, the lower baffle assembly 58 can include four separate baffles, namely baffles 60, 62, 64, and 66, that are each pivotally coupled to the rear wall 34 of the parcel box 20, are independently spring-biased toward deployed positions (FIG. 7), and are each independently movable about a common pivot axis (A2 in FIG. 5) between deployed positions (FIG. 7) and depressed positions (shown in FIG. 8 for baffles 64 and 66). The baffle 60 is shown in FIG. 9 to include a tab 61 which extends laterally outwardly toward the side wall 22. As will be appreciated with reference to FIGS. 1-15, the tab 61 can be received within a recess 70 (FIG. 5) formed in the side wall 22. The recess 70 is defined in part by a ledge 72 (FIG. 5) of the side wall 22. In this configuration, range of motion of the baffle 60 in the upward direction can be limited by contact of the tab 61 with the ledge 72, as shown in FIGS. 7 and 10. Similarly, the baffle 62 can include a tab 63 (FIG. 9) that extends beneath the baffle 60 and selectively contacts the underside of the baffle 60. In this configuration, it will be appreciated that the baffle 62 can be independently depressed from the deployed position to the depressed position without necessarily resulting in movement of the baffle 60; however the baffle 60 cannot be depressed from the deployed position to the depressed position without also resulting in movement of the baffle 62 if not already at least correspondingly depressed.

It will be appreciated that the baffles 64 and 66 can interact with one another and the side wall 24 in a similar manner as the baffles 60 and 62 interact with one another and the side wall 22. For example, range of motion of the baffle 66 in the upward direction can be limited by contact of a tab 67 (FIG. 7) with a ledge (not shown) associated with a recess (not shown) in the side wall 24. The ledge and the recess in the side wall 24 can be similar to the ledge 72 and the recess 70 in the side wall 22. Also, the baffle 64 can include a tab (not shown) that extends beneath the baffle 66 and selectively contacts the underside of the baffle 66. In this configuration, it will be appreciated that the baffle 64 can be independently depressed from the deployed position to the depressed position without necessarily resulting in movement of the baffle 66; however the baffle 66 cannot be depressed from the deployed position to the depressed position without also resulting in movement of the baffle 64 if not already at least correspondingly depressed.

The rear wall 34 can define a receptacle 74 (FIG. 5) such that, when the baffles 60, 62, 64, and 66 are in their respective depressed positions, they can be at least nearly completely received within the receptacle 74 such that they do not obstruct passage of a parcel through the opening 36 to the storage area 56. For example, as shown in FIGS. 9 and 11, the baffles 64 and 66 are in their respective depressed positions and disposed within the receptacle 74.

While the parcel box 20 is shown to include two baffle assemblies (upper baffle assembly 48 and lower baffle assembly 58), it will be appreciated that, in other embodiments, a parcel box can include only a single baffle assembly or instead can include more than two baffle assemblies. While each of the upper baffle assembly 48 and the lower baffle assembly 58 are shown to include a total of four respective baffles, it will be appreciated that in other embodiments, a baffle assembly of a parcel box can include fewer than four baffles or more than four baffles. Also, while each of the upper baffle assembly 48 and the lower baffle assembly 58 are shown to include the same number of baffles (namely, four baffles each), it will be appreciated that in other embodiments, baffle assemblies of a parcel box can include differing quantities of baffles. In the illustrated embodiment, each of the baffles (40, 42, 44 and 46; and 60, 62, 64, and 66) of each respective baffle assembly (upper baffle assembly 48 and lower baffle assembly 58) are shown to be pivotable about a common axis (A1 and A2), though it will be appreciated that in other embodiments a baffle assembly might include baffles than are not pivotable about a common axis.

Figure 12:
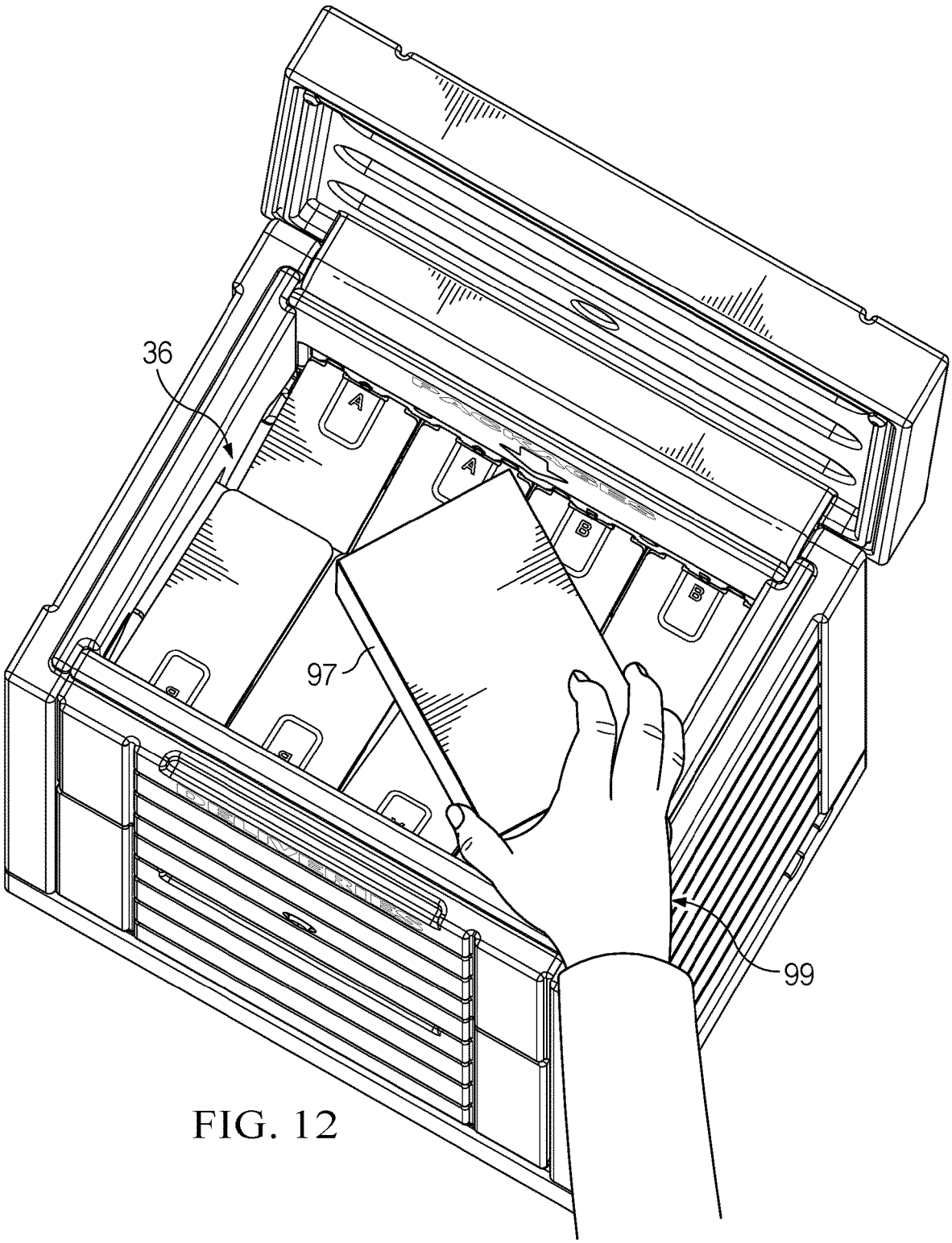
FIG. 12 is a right top perspective view depicting the parcel box in the configuration of FIG. 3, wherein a person's hand is inserting a parcel into an opening of the parcel box.
Figure 13:
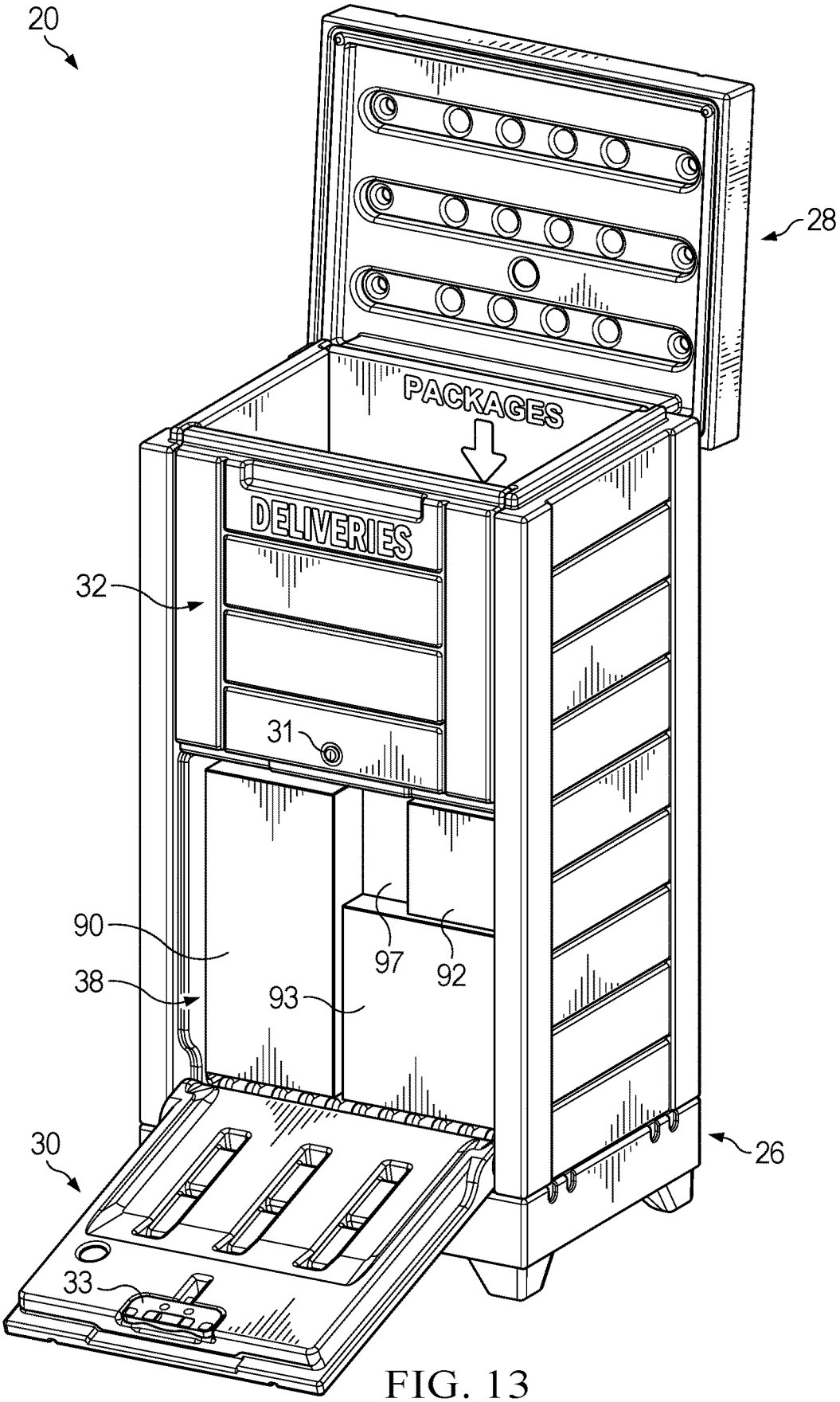
FIG. 13 is a right front perspective view depicting the parcel box in the configuration of FIG. 4, wherein several parcels are located within a storage area of the parcel box.

In use of the parcel box 20, a delivery person can lift the cover 28 from the closed position (FIG. 1) to the opened position (FIG. 12). With reference to FIG. 12, a hand 99 of the delivery person can then drop or urge a parcel 97 through the opening 36, such that the parcel 97 passes vertically past the upper baffle assembly 48 and the lower baffle assembly 58, and comes to rest within the storage area 56. The delivery person can then close the cover 28. A homeowner can then later unlock and open the door 30, such as shown in FIG. 13, so that parcels (90, 92, 93 and 97) can be removed. Upon removal of the parcels, the door 30 can be closed and locked by the homeowner, such that the parcel box 20 is again ready to receive parcels from delivery persons.

Figure 5:
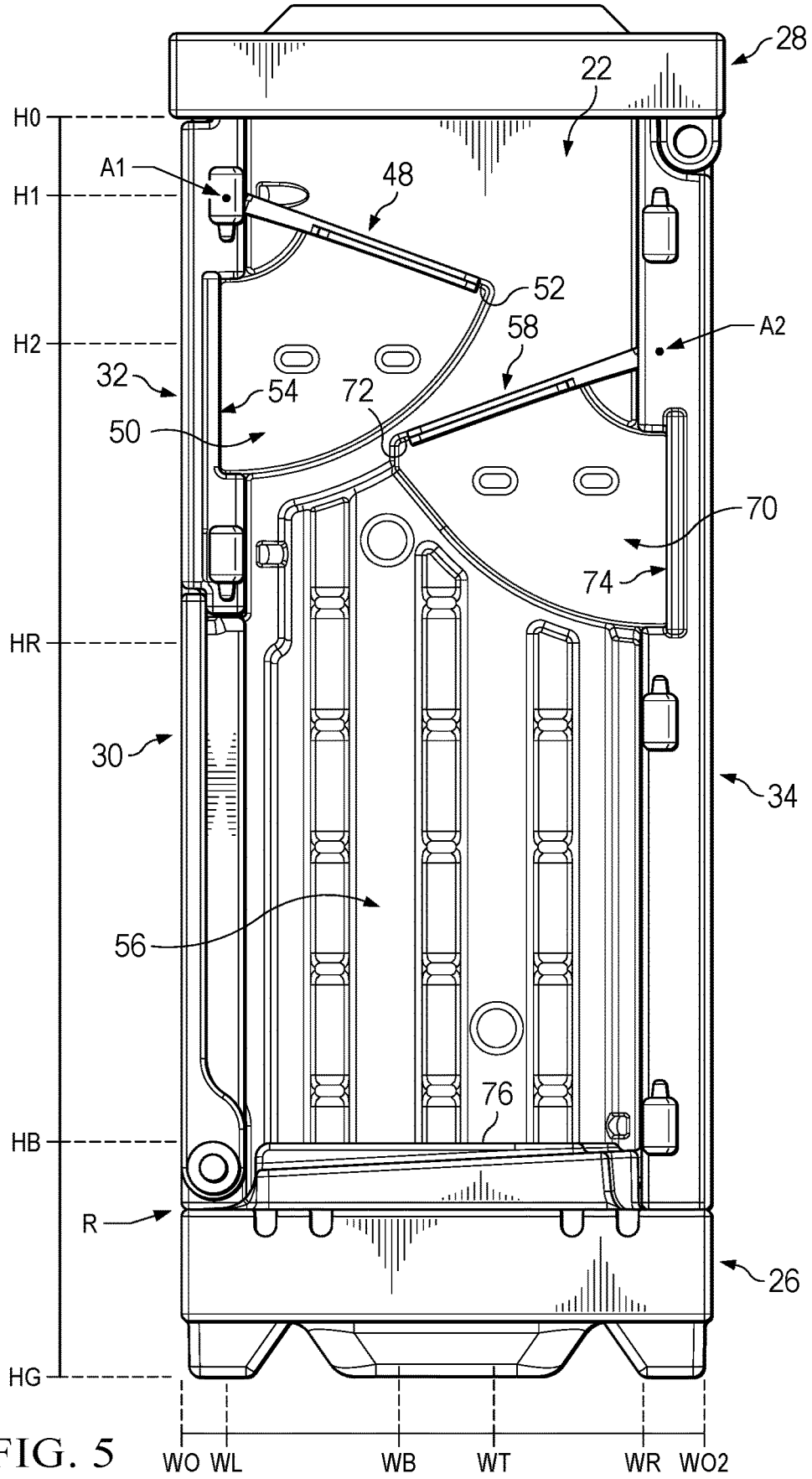
FIG. 5 is a right side elevational view depicting the parcel box in the configuration of FIGS. 1-2, but wherein a right side wall has been removed for clarity of illustration.
Figure 6:
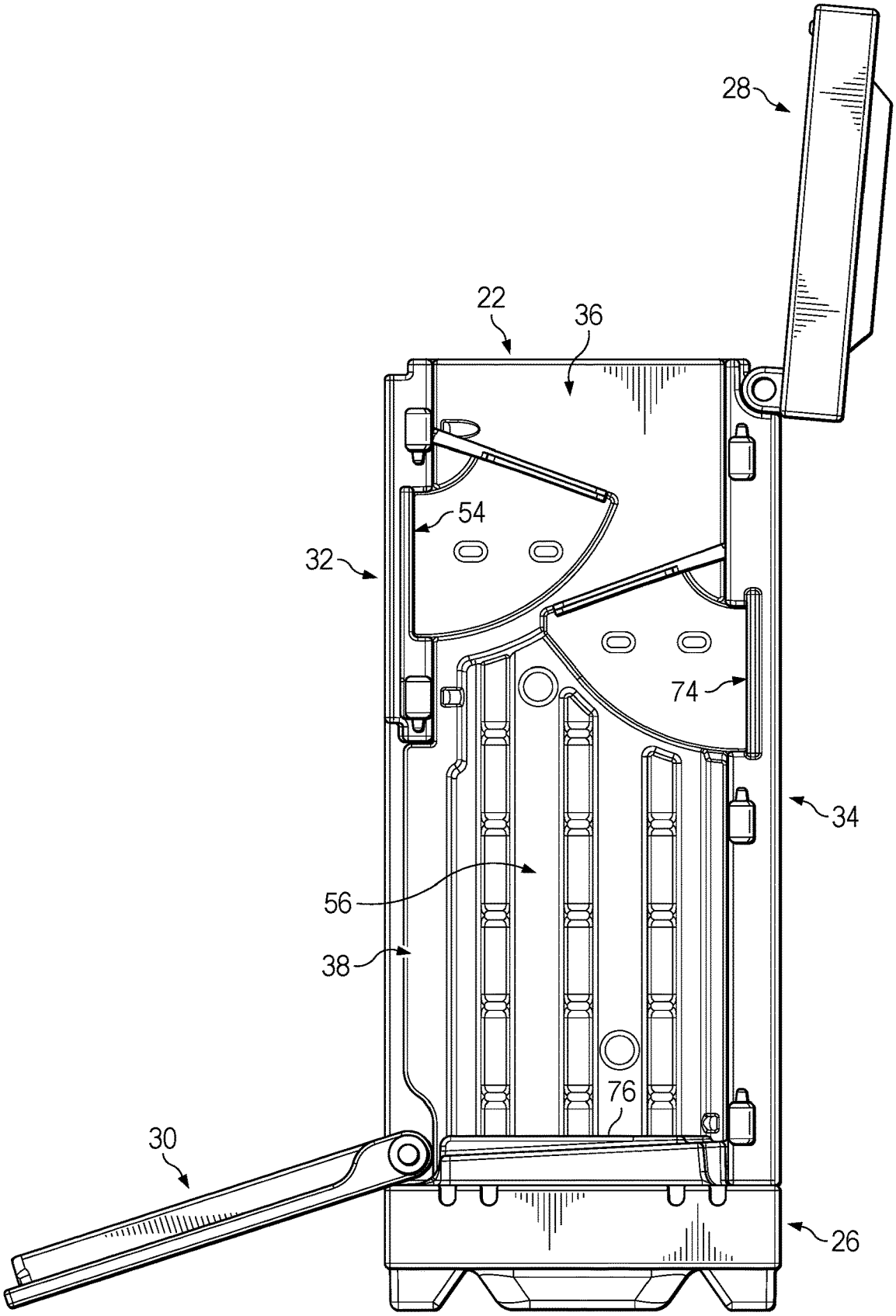
FIG. 6 is a right side elevational view depicting the parcel box in the configuration of FIG. 4, but wherein a right side wall has been removed for clarity of illustration.
Figure 15:
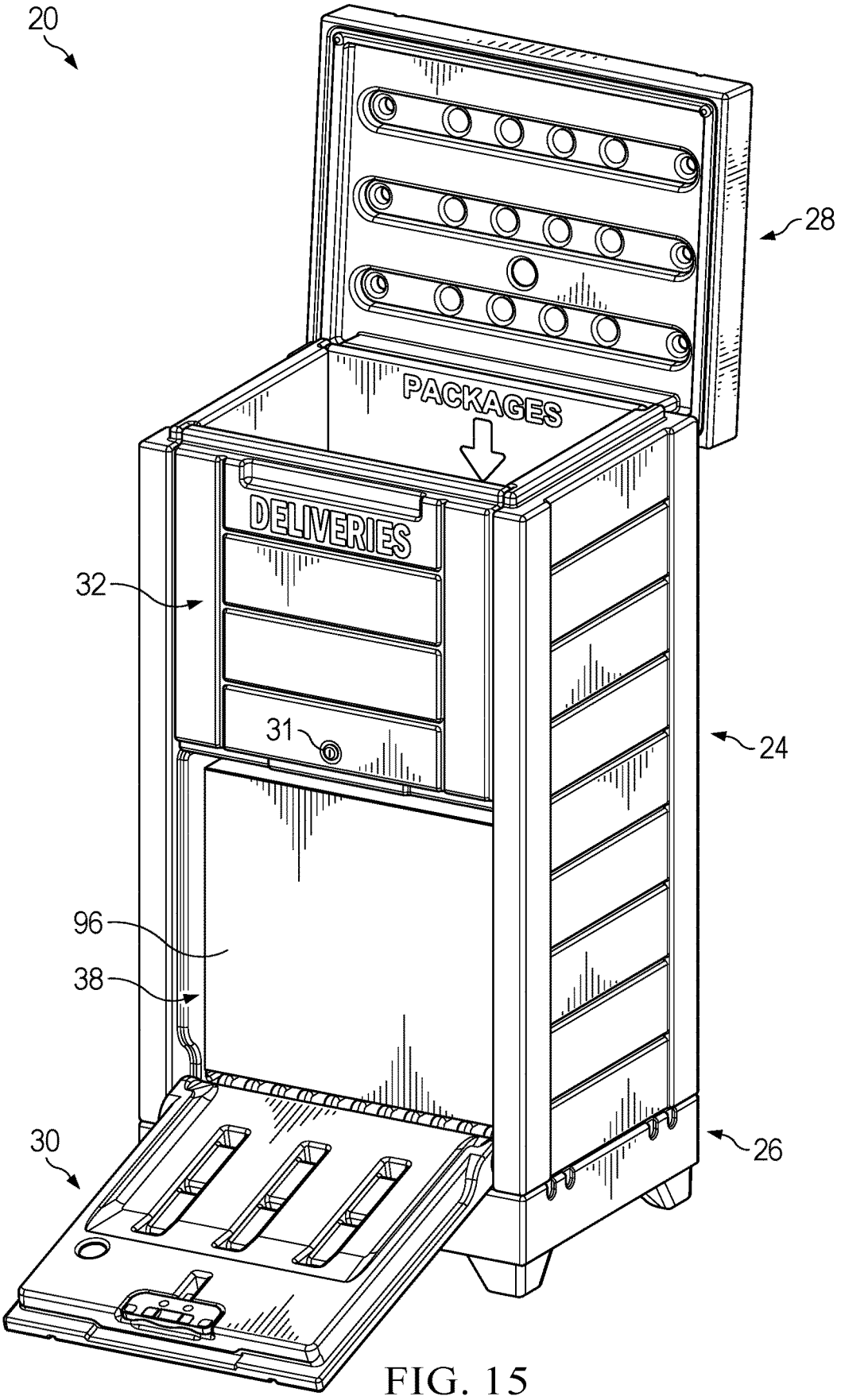
FIG. 15 is a front perspective view depicting the parcel box in the configuration of FIG. 4, wherein a single parcel is located within a storage area of the parcel box.

With reference to FIG. 5, it can be seen that the storage area 56 has an effective width measured from WL-WR and a height measured from HB-HR. It will be appreciated that the storage area 56 can have sufficient volume to simultaneously receive several parcels, as shown for example in FIG. 13. Also, due to the ability of the baffles 40, 42, 44, 46, 60, 62, 64, and 66 to be selectively stored within the receptacles 54 and 74 as described above, it will be appreciated that, in one embodiment and as shown in FIG. 15, the parcel box 20 can receive a very large parcel, such as a single large parcel 96 having nearly the same size as the storage area 56 itself.

Figure 14:
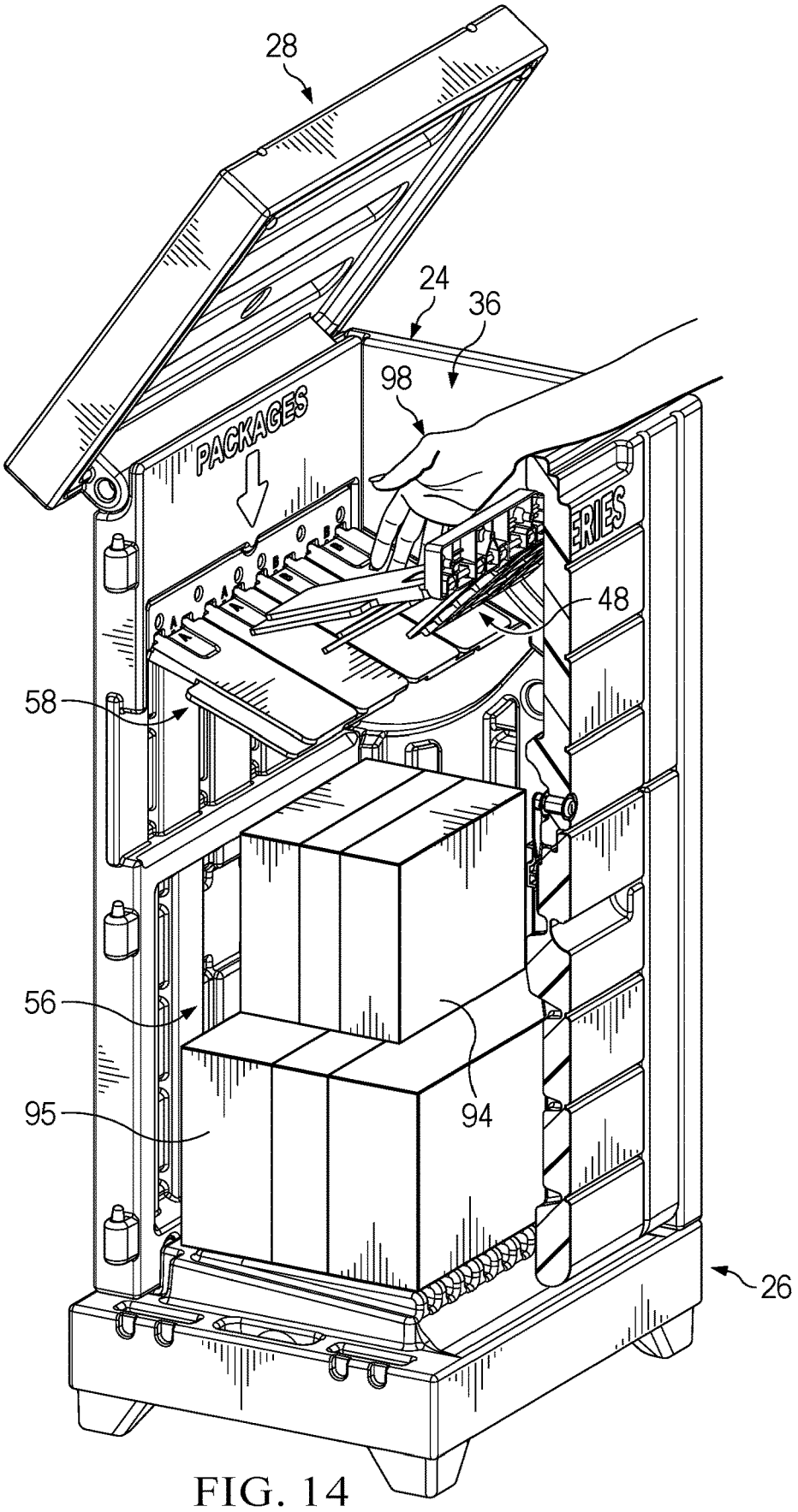
FIG. 14 is a left front perspective view depicting the parcel box in the configuration of FIG. 3, wherein a person's hand is inserted into the opening of the parcel box, parcels are located within a storage area of the parcel box, a left side wall has been removed for clarity of illustration, and portions of the door and a front wall are shown to be cut away for clarity of illustration.

Referring again to FIG. 5, it can be seen that when the baffles 40, 42, 44 and 46 are in the deployed positions, they span a width WL-WT transverse to the direction of parcel travel from the opening 36 to the storage area 56. Also, it can be seen that when the baffles 60, 62, 64 and 66 are in the deployed positions, they span a width WB-WR transverse to the direction of parcel travel from the opening 36 to the storage area 56. In this configuration and when in the deployed positions, the baffles 40, 42, 44 and 46 laterally overlap the baffles 60, 62, 64 and 66 by a width WB-WT transverse to the direction of parcel travel from the opening 36 to the storage area 56. This overlap is facilitated, at least in part, by the pivot axes A1 and A2 being at different heights (H1 and H2, respectively) relative to a ground surface (at height HG) and an uppermost portion of the opening 36 (height HO). At least in part due to this overlap, and due to the height of the uppermost portion of the opening 36 relative to the ground (HO-HG), a thief would have a difficult time maneuvering his hand through the upper and lower baffle assemblies 48 and 58 to reach parcels within the storage area 56. Further, even if the thief were able to reach and grasp a parcel within the storage area 56, it would be difficult for the thief to maneuver the parcel upward and past the upper and lower baffle assemblies 48 and 58, due to the spring-biased tendency of the baffles 40, 42, 44, 46, 60, 62, 64, and 66 to remain in the deployed positions, and due to there being insufficient space through the opening by which to effectively simultaneously accommodate multiple arms and/or tools of the thief as would be beneficial to manually depress enough of the baffles 40, 42, 44, 46, 60, 62, 64, and 66. Furthermore, as described above, due to interaction of the respective baffles 40, 42, 44, 46, 60, 62, 64, and 66 with one another (e.g., with tabs such as 63 shown in FIG. 9) and with ledges (e.g., 52 and 72) in the side walls 22 and 24 (e.g., with tabs 41, 47, 61, and 67), it can be difficult or impossible for a thief to pull the baffles 40, 42, 44, 46, 60, 62, 64, and 66 upward beyond their deployed positions (FIG. 7) to facilitate removal of a parcel from the storage area 56 through the opening 36. FIG. 14 illustrates an example of a hand 98 of a thief attempting to access parcels 94 and 95 within the storage area 56. Due to presence of the upper and lower baffle assemblies 48 and 58 in the flow passage and the resultant difficultly and inconvenience required for attempted removal of a parcel from the storage area 56 through the opening 36, it is believed that thefts of the parcels would be deterred.

With further reference to FIG. 5, the front wall 32 is shown to have a thickness corresponding to WO-WL, the rear wall 34 is shown to have a thickness corresponding to WR-WO2, the base 26 is shown to have a height corresponding to HB-HG, and the bottom opening 38 to the storage area 56 is shown to have a height corresponding to HR-HB. The base 26 can include a floor surface 76 which assists in defining the storage area 56 and provides underlying support to parcels residing within the storage area 56. In one embodiment, as shown in FIG. 5, when the parcel box 20 rests upon level ground (HG), the floor surface 76 can be gently sloped downwardly from adjacent the rear wall 34 toward the bottom opening 38 such that, if the cover 28 is removed and rain enters through the opening 36 and into the storage area 56, water can tend to follow the floor surface 76 toward the door 30 and escape the storage area 56 through a passageway (e.g., marked "R" in FIG. 5) defined between the door 30 and the base 26 and/or side walls 22 and 24. In this way, water can evacuate from the parcel box 20 rather than drowning parcels within the storage area 56.

In a configuration as shown in FIGS. 1-15, in which movement of the cover 28 is not directly tied to movement of any of the baffles 40, 42, 44, 46, 60, 62, 64, 66 (namely, where the cover 28 opens and closes independently from operation of any of the baffles 40, 42, 44, 46, 60, 62, 64, 66), it will be appreciated that a larger sized parcel can be received through the opening 36 and into the storage area 56 (see FIG. 15) than would otherwise be possible. Nonetheless, by having multiple baffle assemblies, such as upper baffle assembly 48 and lower baffle assembly 58, a desired security function can nevertheless be maintained.

It will be appreciated that the parcel box 20 can provide significant flexibility to receive and protect packages of various sizes and quantities from visibility and theft. As an example, in a configuration as shown in FIGS. 1-15, it will be appreciated with reference to FIGS. 8 and 10-11 that a tall parcel (e.g., having a height of approximately HO-HB, a width of WL-WR, and a depth of one half the depth of the storage area 56) can be inserted into and fully retained within one half of the parcel box 20 (e.g., while at least partially displacing baffles 44, 46, 64, and 66 into respective receptacles 54, 74, as shown in FIGS. 8 and 10-11). In this way, the tall parcel can be fully retained within the parcel box 20 and hidden from sight of potential thieves (though it might be subject to easy withdrawal outwardly through the opening 36 by thieves), while the other half of the parcel box 20 can remain capable of securely receiving smaller packages through partial and/or temporary displacement of baffles 40, 42, 60, and 62.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A parcel box comprising:

an external shell comprising:

a left side wall;

a right side wall;

a front wall;

a rear wall;

a base;

a cover movable between a closed position and an opened position, wherein then its opened position, the cover facilitates access by parcels through a top opening and into a storage area; and a door movable between a closed position and an opened position, wherein when in its opened position, the door facilitates removal of parcels from the storage area and through a bottom opening;

an upper baffle assembly comprising a plurality of upper baffles, each upper baffle of the plurality of upper baffles being pivotally coupled to the front wall, independently movable about an upper common pivot axis between a deployed position and a depressed position, and independently spring-biased toward its deployed position; and a lower baffle assembly comprising a plurality of lower baffles, each lower baffle of the plurality of lower baffles being pivotally coupled to the rear wall, independently movable about a lower common pivot axis between a deployed position and a depressed position, and independently spring-biased toward its deployed position;

wherein the plurality of upper baffles comprises:

a first upper baffle comprising a first upper tab extending laterally outwardly toward the left side wall and received within a left upper recess formed in the left side wall, the left upper recess being defined in part by a left upper ledge of the left side wall, wherein a range of motion of the first upper baffle in an upward direction is limited by contact of the first upper tab with the left upper ledge; and a second upper baffle comprising a second upper tab extending beneath the first upper baffle and selectively contacting an underside of the first upper baffle, the second upper baffle being capable of being independently depressed from its deployed position to its depressed position without necessarily resulting in movement of the first upper baffle, and the first upper baffle being incapable of depression from its deployed position to its depressed position without also resulting in movement of the upper baffle if not already at least correspondingly depressed.

2. The parcel box of claim 1 wherein the plurality of upper baffles further comprises:

a third upper baffle comprising a third upper tab extending laterally outwardly toward the right side wall and received within a right upper recess formed in the right side wall, the right upper recess being defined in part by a right upper ledge of the right side wall, wherein a range of motion of the third upper baffle in an upward direction is limited by contact of the third upper tab with the right upper ledge; and a fourth upper baffle comprising a fourth upper tab extending beneath the third upper baffle and selectively contacting an underside of the third upper baffle, the fourth upper baffle being capable of being independently depressed from its deployed position to its depressed position without necessarily resulting in movement of the third upper baffle, and the third upper baffle being incapable of depression from its deployed position to its depressed position without also resulting in movement of the fourth upper baffle if not already at least correspondingly depressed.

3. The parcel box of claim 2 wherein the front wall defines a front receptacle such that, when the first upper baffle, the second upper baffle, the third upper baffle, and the fourth upper baffle are in their respective depressed positions, they are received within the front receptacle such that they do not obstruct passage of a parcel moving through the top opening to the storage area.

4. The parcel box of claim 3 wherein the plurality of lower baffles comprises:

a first lower baffle comprising a first lower tab extending laterally outwardly toward the left side wall and received within a left lower recess formed in the left side wall, the left lower recess being defined in part by a left lower ledge of the left side wall, wherein a range of motion of the first lower baffle in an upward direction is limited by contact of the first lower tab with the left lower ledge;

a second lower baffle comprising a second lower tab extending beneath the first lower baffle and selectively contacting an underside of the first lower baffle, the second lower baffle being capable of being independently depressed from its deployed position to its depressed position without necessarily resulting in movement of the first lower baffle, and the first lower baffle being incapable of depression from its deployed position to its depressed position without also resulting in movement of the second lower baffle if not already at least correspondingly depressed;

a third lower baffle comprising a third lower tab extending laterally outwardly toward the right side wall and received within a right lower recess formed in the right side wall, the right lower recess being defined in part by a right lower ledge of the right side wall, wherein a range of motion of the third lower baffle in an upward direction is limited by contact of the third lower tab with the right lower ledge; and a fourth lower baffle comprising a fourth lower tab extending beneath the third lower baffle and selectively contacting an underside of the third lower baffle, the fourth lower baffle being capable of being independently depressed from its deployed position to its depressed position without necessarily resulting in movement of the third lower baffle, and the third lower baffle being incapable of depression from its deployed position to its depressed position without also resulting in movement of the fourth lower baffle if not already at least correspondingly depressed.

5. The parcel box of claim 4 wherein the rear wall defines a rear receptacle such that, when the first lower baffle, the second lower baffle, the third lower baffle, and the fourth lower baffle are in their respective depressed positions, they are received within the rear receptacle such that they do not obstruct passage of a parcel moving through the top opening to the storage area.

6. The parcel box of claim 1 wherein the upper common pivot axis is parallel with the lower common pivot axis.

7. The parcel box of claim 6 wherein the upper common pivot axis and the lower common pivot axis are at different heights relative to the base.

8. The parcel box of claim 7 wherein, when each upper baffle of the plurality of upper baffles is in its deployed position and each lower baffle of the plurality of lower baffles is in its deployed position, the plurality of upper baffles laterally overlap the plurality of lower baffles by a width that is transverse to a direction of parcel travel extending from the top opening to the storage area.

9. The parcel box of claim 1 wherein the base comprises a sloped floor surface which partially defines the storage area, provides underlying support to parcels residing within the storage area, and facilitates drainage of the storage area.

10. The parcel box of claim 1 wherein the cover is configured to move independently relative to each upper baffle of the plurality of upper baffles and each lower baffle of the plurality of lower baffles.

11. The parcel box of claim 1 wherein the upper baffle assembly and the lower baffle assembly are structurally identical to one another.

12. The parcel box of claim 1 wherein:

the cover is configured to pivot upwardly about an upper horizontal axis to facilitate opening of the cover; and the door is configured to pivot downwardly about a lower horizontal axis to facilitate opening of the door.

13. The parcel box of claim 12 wherein:

the cover is pivotally coupled with each of the left side wall and the right side wall; and the door is pivotally coupled with each of the left side wall and the right side wall.

14. The parcel box of claim 1 wherein:

the left side wall is fixedly fastened to the front wall, the rear wall and the base;

the right side wall is fixedly fastened to the front wall, the rear wall and the base; and the rear wall is fixedly fastened to the base.

15. The parcel box of claim 14 wherein each of the left side wall, the right side wall, the front wall, the rear wall, the base, the cover, and the door are formed of a thermoplastic material.

16. The parcel box of claim 1 further comprising a lock, wherein:

the lock is configured for selective rotation by a removable security key between a latched position and an unlatched position;

when the lock is in its latched position and the door is in its closed position, the lock is configured to maintain the door in its closed position; and when the lock is in its unlatched position, the door is free to move to its opened position.

17. The parcel box of claim 16 wherein the lock is mounted in the front wall.

18. The parcel box of claim 17 wherein the door comprises a reinforced catch plate that selectively interfaces with the lock.

19. The parcel box of claim 1 further comprising a plug, wherein:

the base defines a fill aperture configured to receive ballast; and the plug is configured to facilitate selective sealing of the fill aperture.

20. The parcel box of claim 1 wherein the base defines securement apertures to facilitate securement of the base to a ground surface.

* * * * *